US007753466B2

(12) United States Patent
Shiau

(10) Patent No.: US 7,753,466 B2
(45) Date of Patent: Jul. 13, 2010

(54) DEVICE FOR MANUFACTURING COLOR PRINTING AND METHOD USING SAME

(75) Inventor: Jeng-Nan Shiau, Webster, NY (US)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 873 days.

(21) Appl. No.: 11/614,396

(22) Filed: Dec. 21, 2006

(65) Prior Publication Data

US 2008/0150974 A1 Jun. 26, 2008

(51) Int. Cl.
*B41J 29/38* (2006.01)

(52) U.S. Cl. ..... 347/14; 347/12; 347/19

(58) Field of Classification Search ..... 347/14
See application file for complete search history.

(56) References Cited

U.S. PATENT DOCUMENTS 5,714,195 A 2/1998 Shiba et al.
6,089,693 A * 7/2000 Drake et al. ..... 347/19
6,302,511 B1 * 10/2001 Neese et al. ..... 347/19
2006/0227157 A1 * 10/2006 Drake et al. ..... 347/13

FOREIGN PATENT DOCUMENTS

CN 1121000 A 4/1996
EP 0783973 A2 7/1997

* cited by examiner

*Primary Examiner*—Matthew Luu
*Assistant Examiner*—Brian J Goldberg
(74) *Attorney, Agent, or Firm*—Jeffrey T. Knapp

(57) ABSTRACT

A device (200) for manufacturing a color printing includes a printhead (10), a device (300) for additional printing of the color printing, and a printhead motion and jetting control (100). The device (300) also provided herein includes a printhead identification unit (80) and the host processor (90). The printhead identification unit is configured for identifying type of the N jets, calculating the numbers of the defective jets, and then outputting measurement information of the N jets and the defective jets. The host processor is configured for receiving the measurement information from the printhead identification unit and outputting movement instructions of the printhead with a starting position of the printhead in the first printing process.

20 Claims, 9 Drawing Sheets

DEVICE FOR MANUFACTURING COLOR PRINTING AND METHOD USING SAME

TECHNICAL FIELD

The present invention relates to a device for manufacturing a color printing and a method for manufacturing using the same device.

BACKGROUND

Ink jet technology can be used for applications such as printing of color filters in liquid crystal displays using printheads. In such applications, stringent uniformity requirements on the resulting product must be met. This in turn requires high levels of uniformity and directionality requirement for ink jets of the printheads. A printhead having defective jets cannot meet these requirements. In this case, an additional printing process is always carried out with the printhead replaced with another functioning printhead. However, the whole manufacturing process is both time consuming and complicated. Accordingly, production costs are increased.

What is needed, therefore is to provide a device for manufacturing a color filter which can accomplish the additional printing task using the same printhead.

SUMMARY

A device for manufacturing a color printing provided herein comprises: at least one printhead, a printhead identification unit, a host processor, and a printhead motion and jetting control. The at least one printhead is configured for making color pixels of a color filter by a first printing process. The at least one printhead comprises N jets and M defective jets, wherein N represents a total number of all the jets and M represents a total number of the defective jets and is less than N. The at least one printhead has a first end and an opposite second end, and the N jets are numbered from the one end to the other end such that each of the N jets are assigned a respective jet number, e.g., starting from 0 and ending with N−1. The printhead identification unit is configured for identifying type of the N jets, recording numbers of the defective jets, and then outputting information on the N jets and the defective jets. The host processor is configured for receiving the measurement information from the printhead identification unit and outputting movement instructions for the printhead with a starting position of the printhead in the first printing process. The printhead motion and jetting control is configured for receiving the movement instructions from the host processor and shifting the printhead up with the starting position in the first printing process by a shifting distance such that replacement jets can take the place of the M defective jets. The printhead motion and jetting control turns off all the jets except the replacement jets, and makes the printhead print the color filter in a second printing process.

These and other features, aspects, and advantages of the present method will become more apparent from the following detailed description and claims, and the accompanying drawings.

BRIEF DESCRIPTION OF THE DRAWINGS

Many aspects of the device for manufacturing a color filter can be better understood with reference to the following drawings. The components in the drawings are not necessarily drawn to scale, the emphasis instead being placed upon clearly illustrating the principles of the present method. Moreover, in the drawings, like reference numerals designate corresponding parts throughout the several views.

DETAILED DESCRIPTION OF THE PREFERRED EMBODIMENTS

Figure 1:
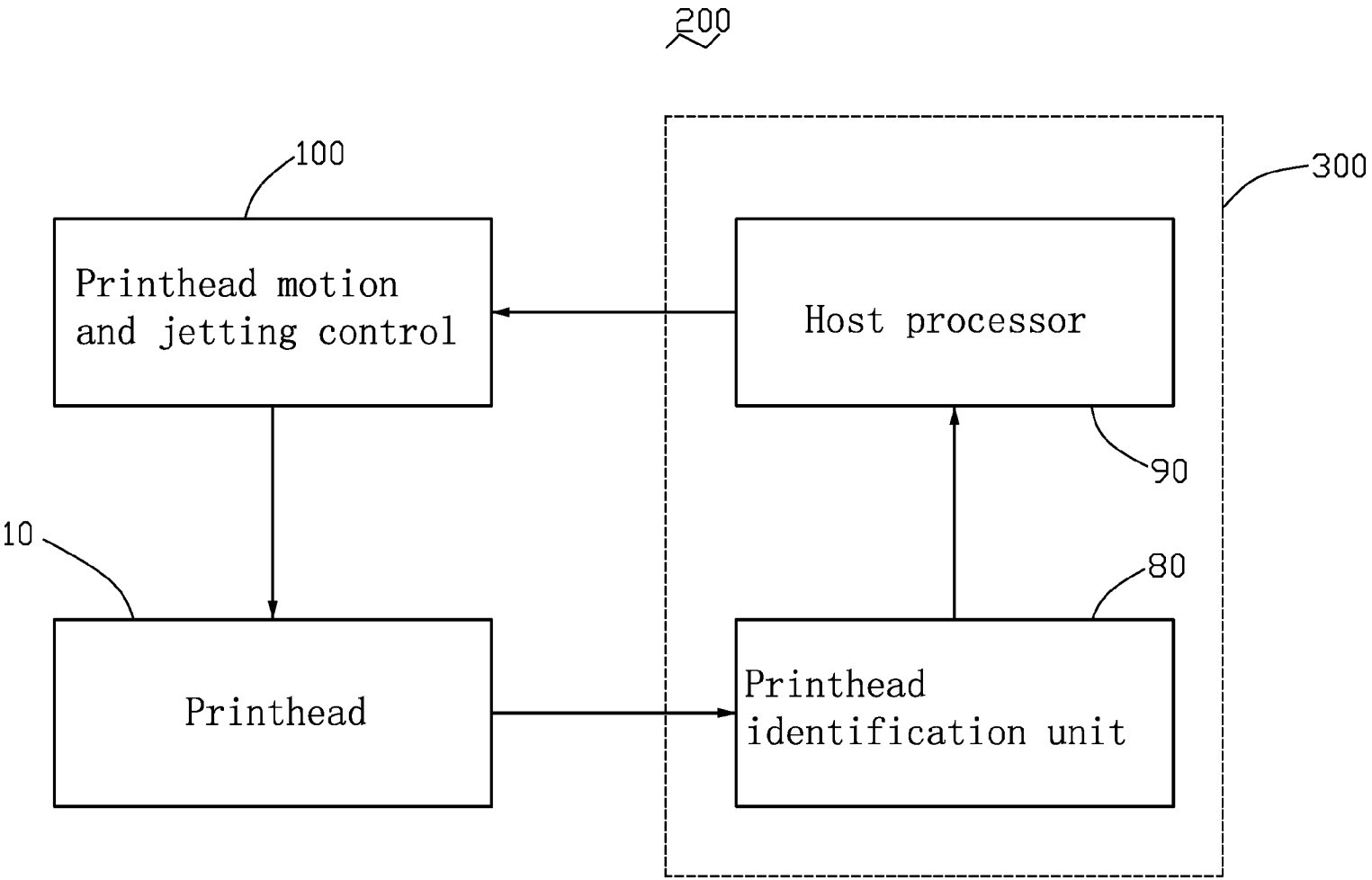
FIG. 1 is a schematic, block diagram of a device for manufacturing a color filter, in accordance with a first embodiment, the device including a printhead and a host processor.

Referring to FIG. 1, a device 200 for manufacturing a color filter or, more generically, creating a high-quality color printing is provided, in accordance with a first embodiment. The device 200 includes a printhead motion and jetting control 100, a printhead 10, and a device 300 for additional printing of the color filter or the high-quality color printing. The device 300 includes a printhead identification unit 80 and a host processor 90. For ease of description, the embodiments are further discussed in relation to the formation of a color filter but the creation of a high-quality color print is considered to be within the scope of the discussion.

Referring to FIG. 1, the printhead motion and jetting control 100 is configured (i.e., structured and arranged) for moving the printhead 10 an appropriate distance and controlling ink ejection of the printhead 10.

Figure 2:
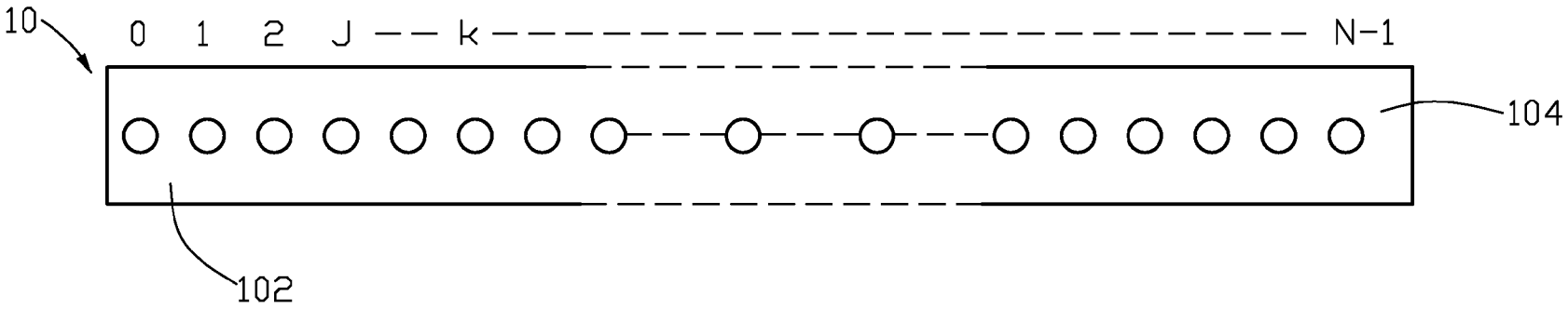
FIG. 2 is a schematic, bottom view of the printhead shown in FIG. 1 with the printhead including N jets.

Referring to FIG. 2, the printhead 10 includes N jets, wherein N represents a total number of jets. The printhead 10 has a first end 102 and an opposite second end 104. The N jets are numbered from the one end to the other end such that each of the N jets are assigned a respective jet number, e.g., starting from 0 and ending with N−1. Furthermore, the printhead 10 includes M defective jets amongst the N jets, wherein M represents a total number of the defective jets and is less than N. In this embodiment, the printhead 10 includes two defective jets, i.e. jet K and jet J, wherein K and J are the numbers of jets and K is greater than J.

Figure 3:
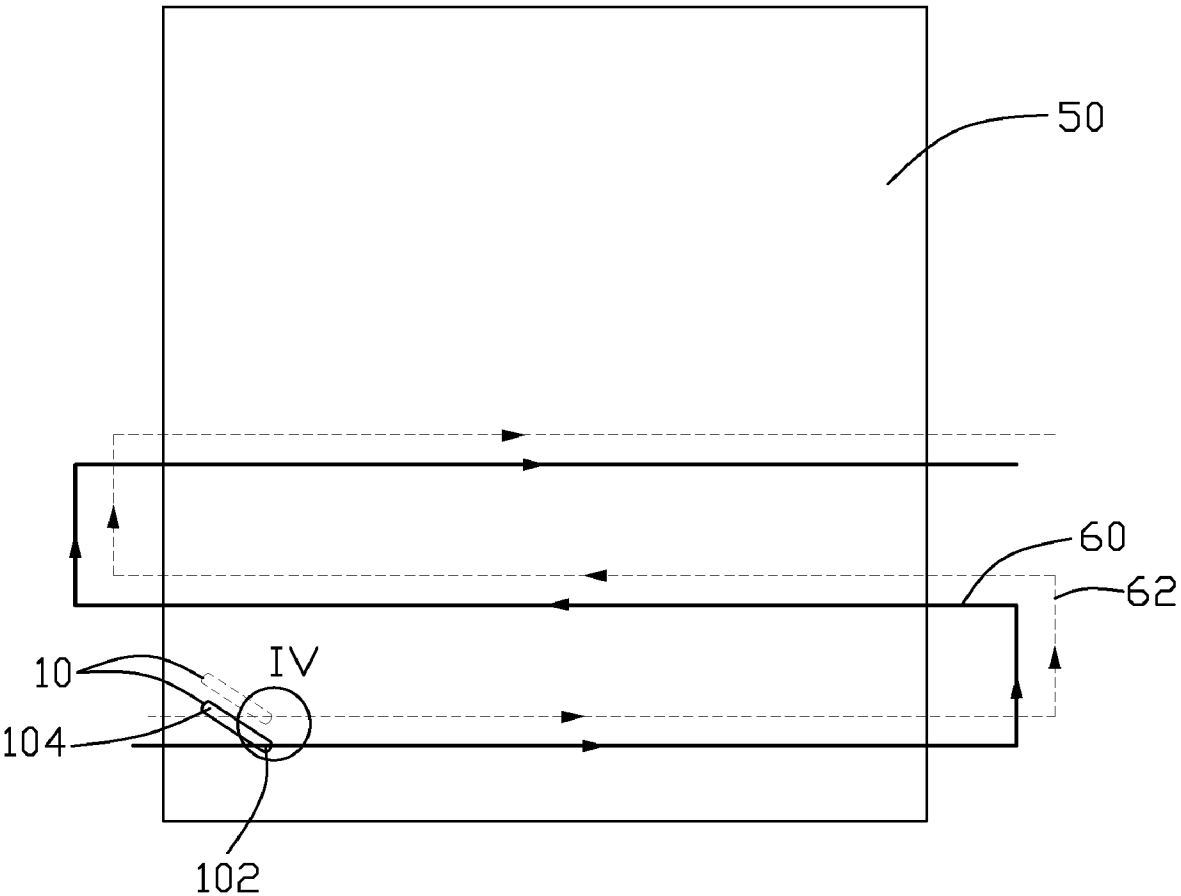
FIG. 3 is schematic view showing a process for manufacturing the color filter, using the device shown in FIG. 1.
Figure 4:
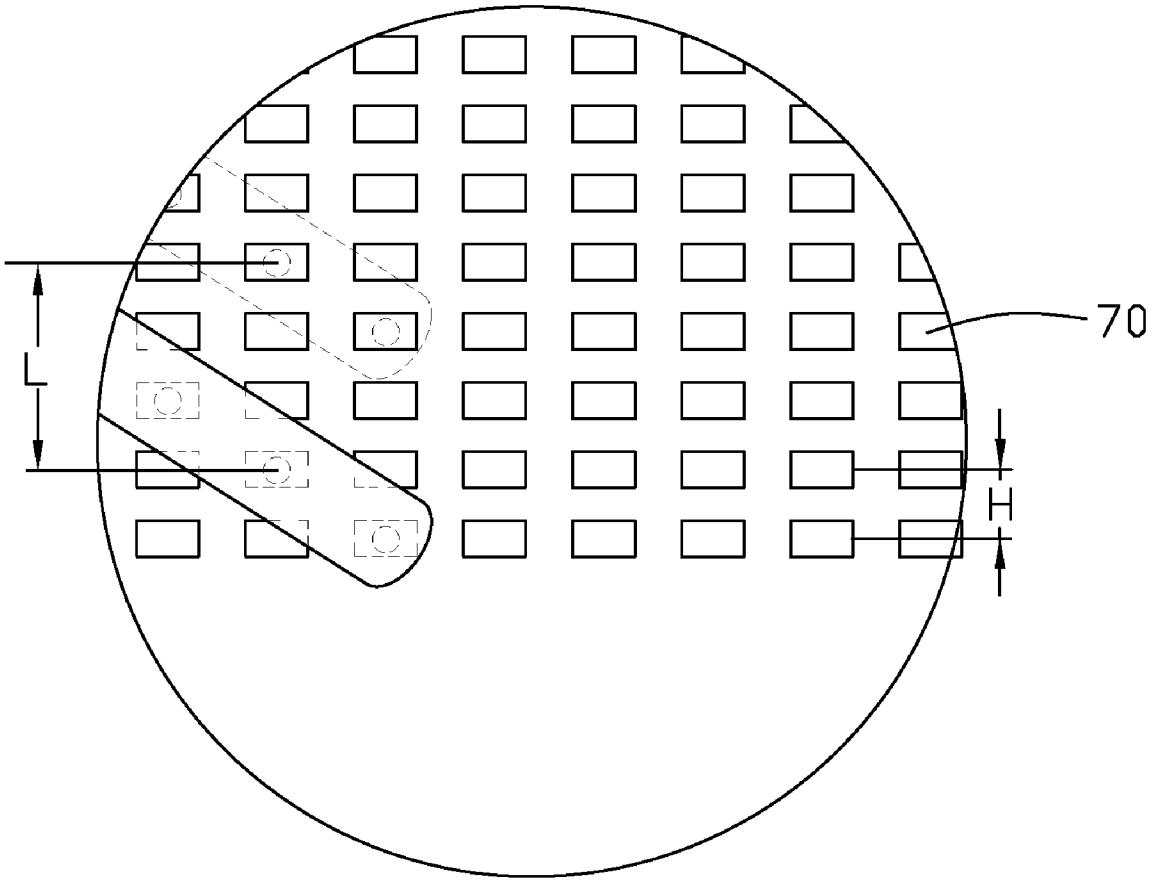
FIG. 4 is an enlarged view of part IV of FIG. 3.

Referring to FIGS. 3 and 4, the printhead 10 is controlled by the printhead motion and jetting control 100 to print ink on a base 50 for making color pixels 70 of a color filter in a first printing process 60. The color pixels 70 are arranged in rows. A distance between neighboring rows of the color pixels 70 is represented by H. The N jets of the printhead 10 correspond to N rows of the color pixels 70.

Referring to FIG. 1, the printhead identification unit 80 is configured for measuring properties of the N jets thus allowing the calculation of the quantity of defective jets. The properties measured can include the droplet size and directionality of all the jets. The measurement information of the N jets and the defective jets, such as the total numbers of the N jets and the numbers of the defective jets, are then communicated to the host processor 90.

The host processor 90 is configured for receiving the measurement information of the N jets and the defective jets from the printhead identification unit 80. Furthermore, the host processor 90 also determines a starting position of the printhead in the first printing process 60. Accordingly, referring to FIGS. 3 and 4, the host processor 90 will send movement instructions to the printhead motion and jetting control 100 to shift the printhead 10 a distance L from the starting position of the first printing process 60 to a second starting position.

The movement instructions include the shifting distance L being equal to SH or (N−S)H, wherein S represents a number of rows of color pixels 70. It should be noted that, because of the cyclic nature of the printing, shifting the printhead 10 up SH is equivalent to shifting the printhead 10 down by (N−S) H. S is less than N and is any natural number other than the difference between every two numbers of the defective jets when M is more than or equal to two. S can be any integer when M is equal to 1.

Figure 5:
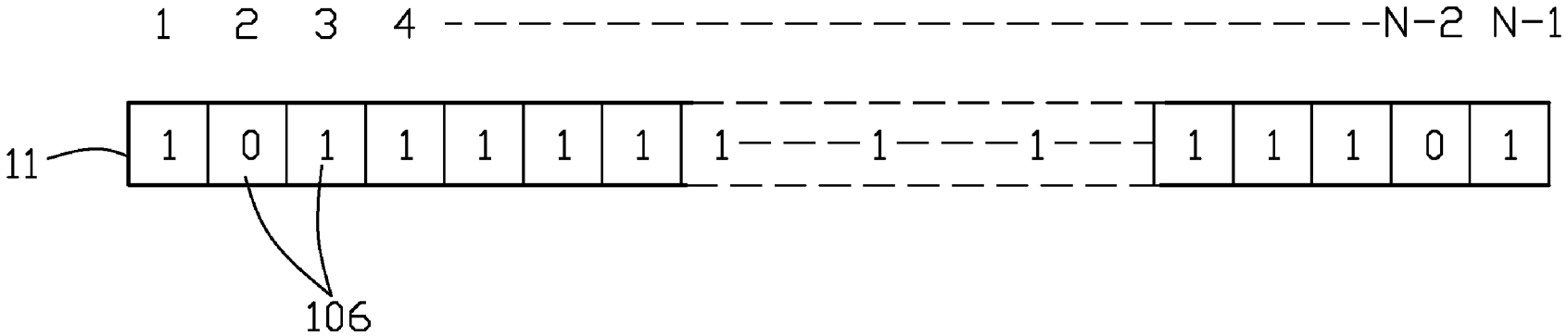
FIG. 5 is schematic diagram showing a memory of the host processor, as shown in FIG. 1, the host processor being in an adjusted state.

Referring to FIG. 5, for searching for the movement instructions, a list 11 consisting of (N−1) shifting datum 106 are allocated in the memory of the host processor 90. The shifting datum 106 is sequentially numbered from 1 to N−1. If the shifting data/datum 106 is zero, it means that the shifting member S cannot be equal to the sequence number at which the shifting data 106 is. If the shifting datum 106 is one, it means that the shifting member S can be equal to the sequence number at which the shifting data 106 is.

In this embodiment, S cannot be equal to (K−J), i.e. S cannot be equal to 2. That is, S can be any integer between 1 and N−1 except 2 and (N−2). Therefore, in the list 11, the shifting datum 106 at the sequence number 2 and (N−2) are both assigned a value of zero. The other shifting datum 106 is assigned a value of 1.

Consequently, referring to FIGS. 3 and 4, the printhead motion and jetting control 100 then move the printhead 10 to the second starting position, and, thereby, some functional jets, as replacement jets, will take the place of the defective jets, corresponding to unprinted color pixels, which originally face the defective jets and need to be repaired. A second printing process 62 is next carried out as a repairing printing.

Referring to FIG. 1, in the first printing process 60, the printhead motion and jetting control 100 controls the printhead 10 to move from left to right first. The printhead 10 then steps up a distance equal to NH. The printhead 10 moves from right to left and prints a second swath. The process is repeated until the color pixels in the base 50 are all printed as desired. All the jets of the printhead 10 traverse parallel horizontal paths in printing.

The printhead identification unit 80 sorts out the defective jets K, J according to results of measurements of the N jets during the first printing process 60 or a previous detection before the first printing process 60. The related measurement information will be sent from the printhead identification unit 80 to the host processor 90.

The host processor 90 initially has the shifting datum 106 set to 1 in its memory with the printhead 10 being in the starting position. In accordance with the measurement information from the printhead identification unit 80, the host processor 90 adjusts its memory by setting the shifting datum 106 at the sequence number of the difference between every two numbers of the defective jets to be zero. In this embodiment, since (K−J) is equal to 2, the shifting datum 106 at the sequence number 2 and (N−2) are adjusted to be zero. S is then chosen from the sequence numbers of the shifting datum still assigned a value of 1. Referring to FIG. 4, S is 3 and the shifting distance L is 3H.

The host processor 90 determines S and transmits the movement instructions to the printhead motion and jetting control 100 to shift the printhead 10 by a shifting distance L such that two replacement jets take the place of the defective jets. In the next second printing process 62, all jets are turned off except the replacement jets.

Alternatively, if a single jet of the printhead 10 is defective and is turned off during printing, rows of sub-cells of the corresponding color separated by a distance of NH will not be printed. This can be repaired by a second printing process 62 using a printhead starting position shifted by a shifting distance such that another jet takes the place of the defective jet.

Figure 6:
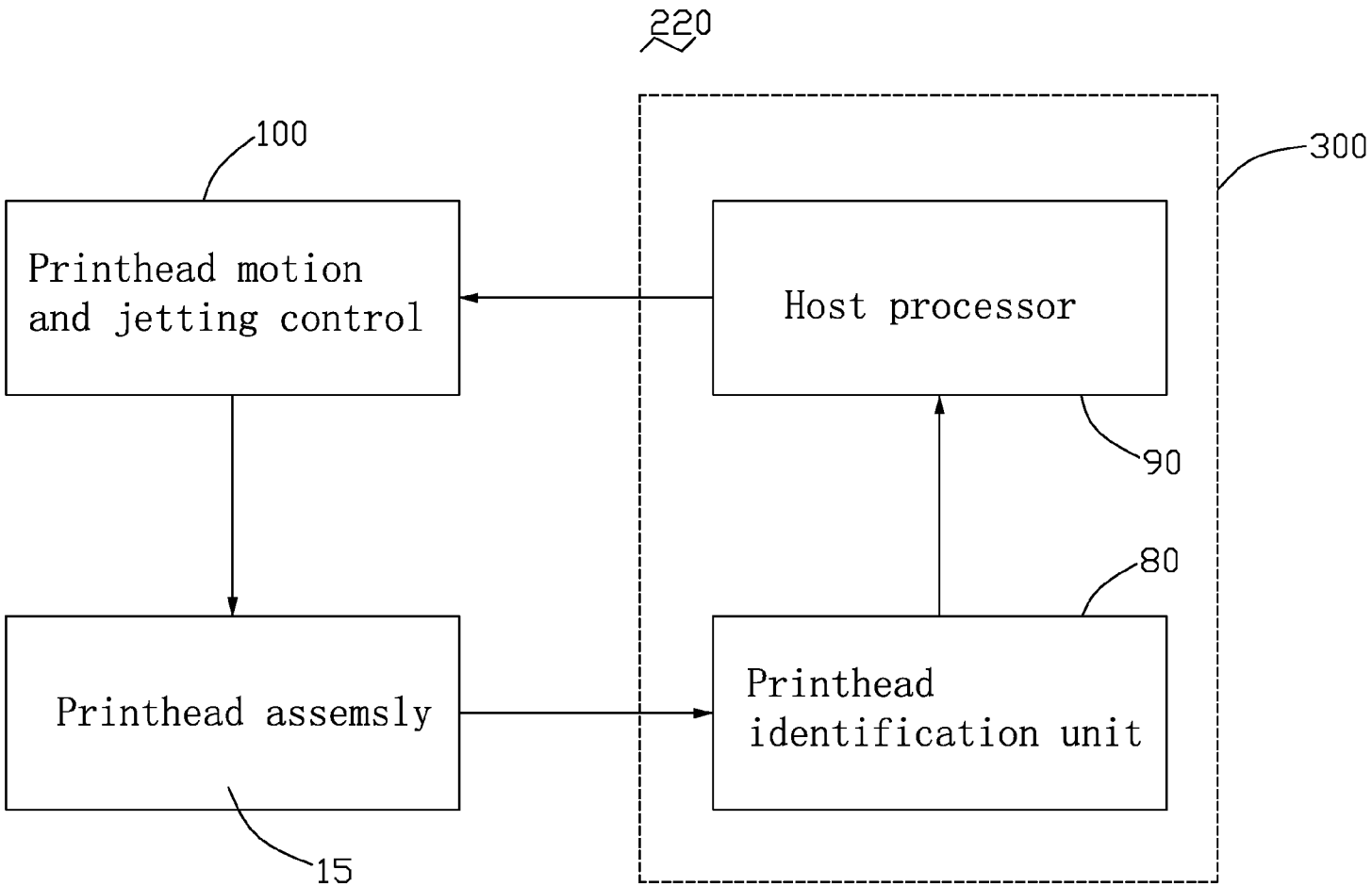
FIG. 6 is a schematic, block diagram of a device for manufacturing a color filter, in accordance with a second embodiment, the device including a printhead assembly and a host processor, the printhead assembly including three printheads.
Figure 7:
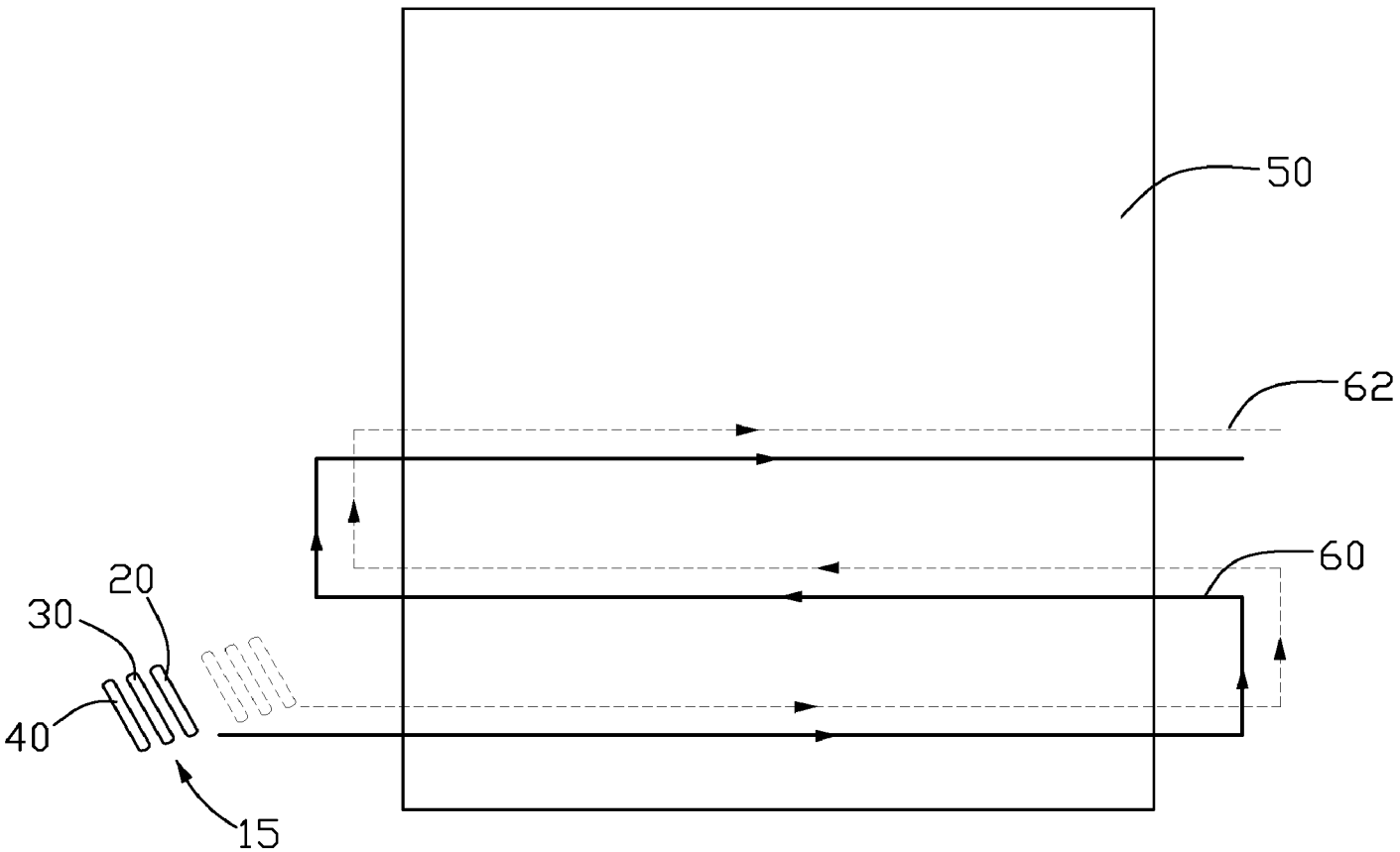
FIG. 7 is schematic view showing a process for manufacturing the color filter, using the device shown in FIG. 5.

Referring to FIGS. 6 and 7, a device 220 for manufacturing a color filter is provided in accordance with a second embodiment. The device 220 includes a printhead assembly 15, the device 300 and the printhead motion and jetting control 100. The device 300 includes the printhead identification unit 80 and the host processor 90.

The main difference between the device 200 of the first embodiment, and the device 220 is that the printhead assembly 15 of the device 220 consists of a first printhead 20, a second printhead 30, and a third printhead 40 parallel to the first and second printheads 20, 30. The printheads 20, 30, 40 can eject ink of red, green, and blue colors respectively. Each of the printheads 20, 30, 40 comprises N jets, wherein N represents a total number of jets. The printheads 20, 30, 40 each have a first end and an opposite second end, wherein the N jets are numbered from the first end to the second end starting from 0 and ending with N−1. The printheads 20, 30, 40 each correspond to N rows of color pixels. The first and second printheads 20, 30 comprise M1 and M2 defective jets, respectively, wherein M1 and M2 represent a total number of the defective jets and both are less than N.

Similarly, the printhead identification unit 80 sorts out the numbers of the defective jets of both of the printheads 20, 30 and communicates the measurement information to the host processor 90. The host processor 90 then sends the movement instructions to the printhead motion and jetting control 100 to shift the printheads 20, 30 with a shared shifting distance L from the starting position of the first printing process 60 to a second starting position.

The shifting distance L is equal to SH or (N−S)H, wherein S represents a number of rows of color pixels 70. S should be less than N. When M1 and M2 are more than or equal to two, S is any integral number other than the difference between every two numbers of the defective jets of each of the first and second printheads. When M1 and M2 both equal to 1, S can be any integral number less than N.

Figure 8:
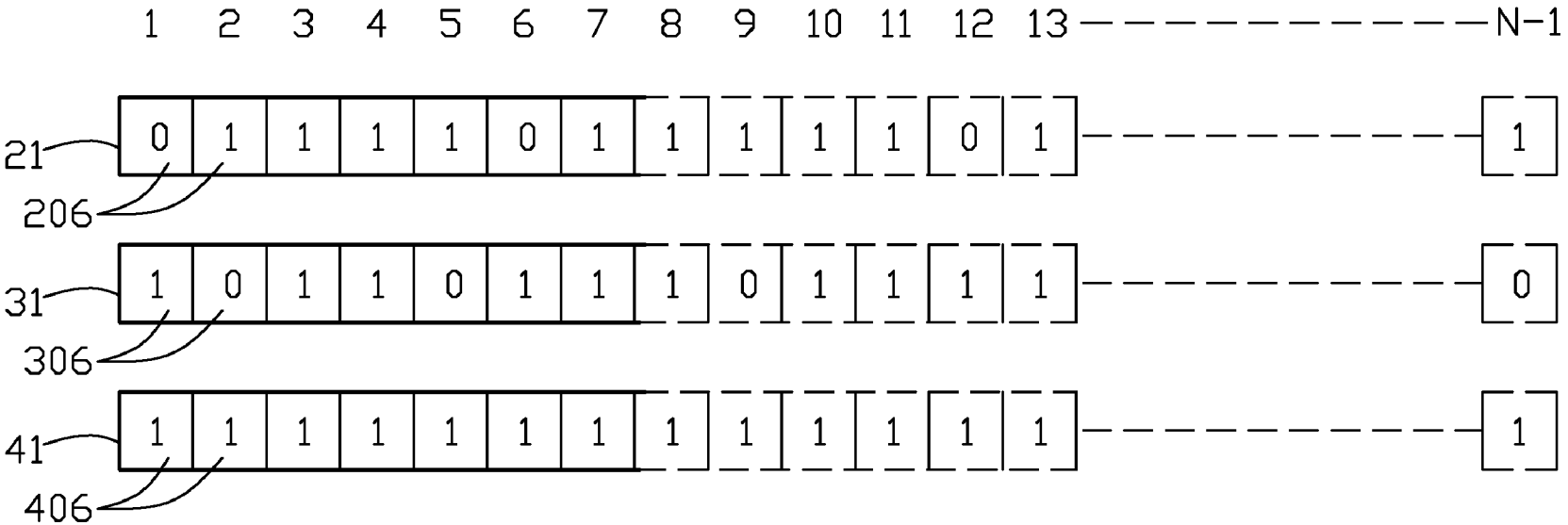
FIG. 8 is schematic diagram showing a memory of the host processor, as shown in FIG. 5, the host processor being in an adjusted state compensating for two printheads of the printhead assembly having defective jets.

Referring to FIG. 8, for searching for the movement instructions, a first list, a second list and a third list 21, 31, 41, each consisting of (N−1) shifting datum 206, 306, 406, are allocated in the memory of the host processor 90. The shifting data 206, 306, 406 are sequentially numbered from 1 to N−1. In the first list 21, the shifting datum 206 at the sequence numbers 1, 6, 12 is assigned values of zero. In the second list 31, the shifting datum 306 at the sequence numbers 2, 5, 9 is assigned values of zero. The other shifting datum 206, 306 and all the shifting datum 406 are assigned values of 1.

In process, the shifting data 206, 306, 406 are initially assigned the value 1 with the printhead assembly 15, being in the starting position. According to the measurement information from the printhead identification unit 80, the shifting datum 206, 306 at the sequence number of the difference between every two numbers of the defective jets of each of the printheads 20, 30 will be adjusted to be zero.

In this embodiment, in the printhead 20, the difference between every two numbers of the defective jets can be, for example, 1, 6, 12. Accordingly, in the first list 21, the shifting datum 206 at the sequence numbers 1, 6, 12 is adjusted to be zero. In the printhead 30, the difference between every two numbers of the defective jets can be, for example, 2, 5, 9. Accordingly, in the second list 31, the shifting datum 306 at the sequence numbers 2, 5, 9 is adjusted to be zero.

Furthermore, a shared value of S of the printheads 20, 30 is chosen from the sequence numbers of the lists at which the shifting datum of the lists is 1, such as 3, 4.

The printhead motion and jetting control 100 shifts the printheads 20, 30 with the shifting distance L, according to the movement instructions from the host processor 90, such that the replacement jets take the place of the defective jets. The second printing process 62 for repairing can then be carried out.

In an alternative embodiment, the three printheads 20, 30, 40 of the printhead assembly 15 all have defective jets, wherein the printhead 40 may have M3 defective jets. Correspondingly, referring to FIG. 9, the three lists 21, 31, 41 in the memory of the host processor 90 all have the shifting datum 206, 306, 406 recorded as zero. In the first list 21, the shifting datum 206 at the sequence numbers 2, 7, 13 is recorded to be zero. In the second list 31, the shifting datum 306 at the sequence numbers 4, 9, 11 is recorded to be zero. In the third list 41, the shifting datum 406 at the sequence numbers 1, 5, 8, 10 is recorded to be zero. The other shifting data 206, 306, 406 are recorded to be 1.

Figure 9:
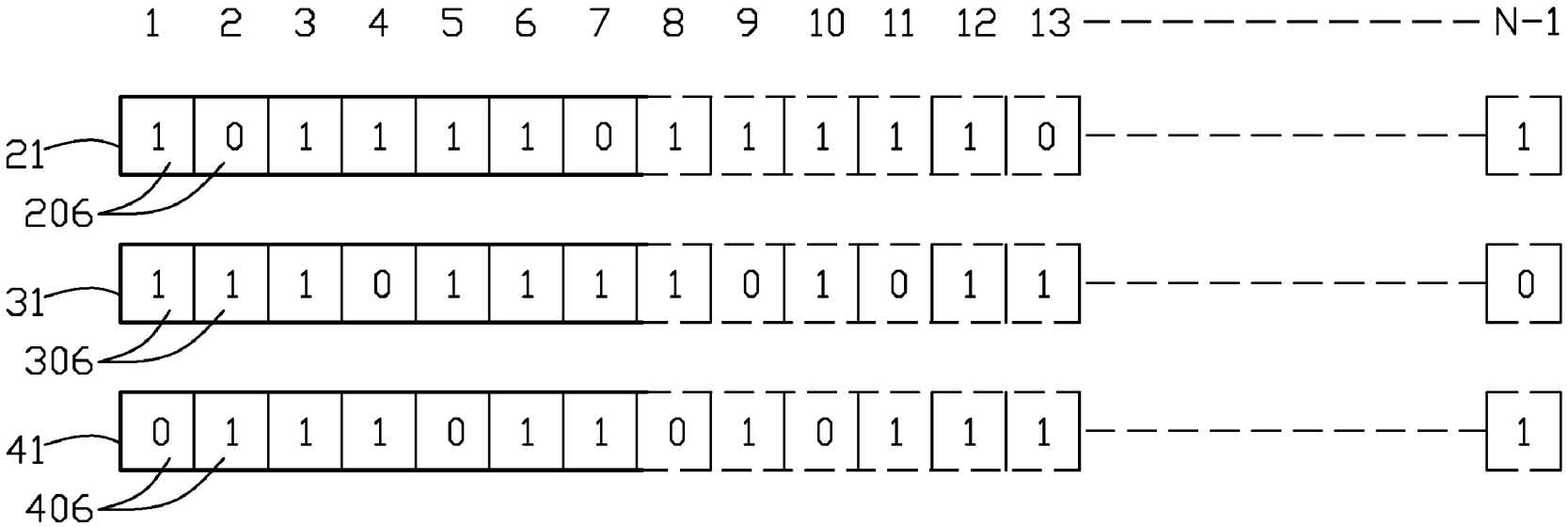
FIG. 9 is schematic diagram showing a memory of the host processor, as shown in FIG. 5, the host processor being in an adjusted state compensating for three printheads of the printhead assembly having defective jets.

In process, the printhead identification unit 80 also communicates the information of the printhead 40 to the host processor 90. Referring to FIG. 9, the host processor 90 similarly adjusts the corresponding shift datum in the three lists 21, 31, 41. A shared S of the printheads 20, 30, 40 is determined by picking one of the sequence numbers of the shifting datum in which the shifting datum of the three lists are still assigned a value of 1, such as the sequence numbers 3, 6.

As a result, the printhead assembly 15 is shifted with the shared shifting distance L. The unprinted color pixels are repaired by the second printing process 62. Otherwise, if the shared shifting distance can be found only for two printheads, then a third printing process is required. If no shared shifts can be found, a fourth printing process would need to be made.

In summation, the device for manufacturing a color filter or, more generically, a color printing provided herein can accomplish a repairing printing task using the same printhead used in a previous manufacturing process, when the printhead has some defective jets. In particular, when the printhead finishes a first printing process, the printhead is able to shift up with a shifting distance such that functional jets can take the place of the defective jets to carry out a second printing process, as a repair step.

Finally, while the present invention has been described with reference to particular embodiments, the description is illustrative of the invention and is not to be construed as limiting the invention. Therefore, various modifications can be made to the embodiments by those skilled in the art without departing from the true spirit and scope of the invention as defined by the appended claims.

What is claimed is:

1. A device for manufacturing a color printing, the device comprising:

at least one printhead for making color pixels of a color printing by a first printing process, each printhead comprising N jets and M defective jets, wherein N represents a total number of all the jets and M represents a total number of the defective jets, M is less than N, wherein the at least one printhead has a first end and an opposite second end, and the N jets are numbered in sequence from the first end to the second end such that each of the N jets are assigned a respective jet number;

a printhead identification unit for identifying defective jets to include within the N jets, determining the respective jet numbers of the M defective jets, and then outputting measurement information of the N jets and the M defective jets of each printhead;

a host processor for receiving the measurement information from the printhead identification unit and outputting movement instructions of the at least one printhead with a starting position of the printhead in the first printing process; and a printhead motion and jetting control for receiving the movement instructions from the host processor and shifting the at least one printhead up with the starting position in the first printing process by a shifting distance such that replacement jets take the place of the M defective jets in each printhead, wherein the printhead motion and jetting control turns off all the jets except the replacement jets and makes the printhead carry out a second printing process on the color printing.

2. The device claimed in claim 1, wherein the color pixels are arranged in rows, the N jets of the at least one printhead correspond to N rows of the color pixels, respectively, wherein the movement instructions include the shifting distance equal to SH or (N−S)H, wherein H represents a distance between neighboring rows of the color pixels, wherein S represents a number of rows of color pixels, wherein S is less than N, wherein S is any integer other than the difference between every two numbers of the defective jets when M is more than or equal to two, wherein S is any integer when M is equal to 1.

3. The device claimed in claim 1, wherein the host processor determines the starting position of the at least one printhead in the first printing process.

4. The device claimed in claim 2, wherein N−1 shifting datum are allocated in a memory of the host processor, wherein the shifting datum are sequentially numbered from 1 to (N−1), wherein the (N−1) shifting datum are all set to 1 initially with the at least one printhead being in the starting position, the shifting datum at the sequence numbers being equal to the difference between every two numbers of the defective jets are then adjusted to be zero in accordance with the measurement information from the at least one printhead identification unit, wherein S can be equal to the sequence number of the shifting datum still assigned a value of 1.

5. The device claimed in claim 1, wherein the device comprising a first printhead, a second printhead, and a third printhead parallel to the first and second printheads, wherein the first and second printheads comprise M1 and M2 defective jets in the N jets, respectively, wherein M1 and M2 represent a total number of the defective jets and both are less than N; the first and second printheads are shifted up by the printhead motion and jetting control with the starting position in the first printing process by a shared distance in a manner such that replacement jets can take the place of the M1 and M2 defective jets, respectively.

6. The device claimed in claim 5, wherein the movement instructions include the shared shifting distance SH or (N−S)H, wherein H represents a distance between neighboring rows of the color pixels, wherein S represents a number of rows of color pixels, wherein S is less than N, wherein S is any integral number other than the difference between every two numbers of the defective jets of each of the first and second printheads when M1 and M2 are more than or equal to two, wherein S is any integral number when M1 and M2 are equal to 1.

7. The device claimed in claim 6, wherein three lists each consisting of N−1 shifting datum are allocated in a memory of the host processor, wherein the shifting datum are sequentially numbered from 1 to (N−1), wherein the shifting datum in the lists are all set to 1 initially in the starting positions, and the shifting datum at the sequence numbers of the difference between every two numbers of the defective jets of each of the first and second printheads are then adjusted to be zero in accordance with the measurement information from the printhead identification unit, wherein S can be equal to a shared sequence number of the three lists at which the shifting datum thereof are still assigned a value of 1.

8. The device claimed in claim 5, wherein the third printhead comprises M3 defective jets in the N jets, wherein M3 represent a total number of the defective jets and is less than N, wherein the third printhead is also shifted with the first and second printheads with the starting positions in the first printing process by a shared distance equal to S or (N−S) rows of the color pixels such that enabling replacement jets take the place of the defective jets, wherein S is less than N, wherein S is any natural number other than the difference between every two numbers of the defective jets of each of the printheads when M1, M2 and M3 are more than or equal to two, wherein S is any integral number when M1, M2 and M3 are equal to 1.

9. The device claimed in claim 8, wherein three lists each consisting of N−1 shifting datum are allocated in a memory of the host processor, wherein the shifting datum are sequentially numbered from 1 to (N−1), wherein the shifting datum in the lists are all set to 1 initially within the starting positions, and the shifting datum at the sequence numbers of the difference between every two numbers of the defective jets of each of the printheads are then adjusted to be zero in accordance with the measurement information from the printhead identification unit, wherein S can be equal to a shared sequence number of the three lists at which the shifting datum thereof are still assigned a value of 1.

10. The device claimed in claim 7, wherein the first, second, and third printheads are configured for printing ink of red, blue, and green colors, respectively.

11. The device claimed in claim 1, wherein the color printing is a color filter.

12. A method for manufacturing a color printing, the method comprising the steps of:

providing at least one printhead each comprising N jets, wherein N represents a number of jets, wherein each printhead comprises at least two defective jets in the N jets, wherein each printhead has a first end and an opposite second end, wherein the N jets are numbered from the first end to the second end such that each of the N jets are assigned a respective jet number;

moving the at least one printhead and printing ink on a base for making color pixels of a color printing by a first printing process, wherein the color pixels are arranged in rows, wherein the N jets of the at least one printhead correspond to N rows of the color pixels;

shifting the at least one printhead up with a starting position in the first printing process by a shifting distance equal to SH or (N−S)H such that at least two replacement jets take the place of the at least two defective jets, wherein H represents distance between neighboring rows of the color pixels, wherein S represents a number of rows of color pixels wherein S is less than N, wherein S is any integral number other than the difference between every two numbers of the defective jets in the at least one printhead; and turning off all the jets except the replacement jets, and controlling the at least one printhead to print the color printing in a second printing process.

13. The method according to claim 12, wherein a printhead identification unit selects the defective jets and then outputs measurement information of the N jets and the defective jets to a host processor.

14. The method according to claim 13, wherein the host processor receives the measurement information from the printhead identification unit and outputs movement instructions of the at least one printhead with a starting position of each printhead in the first printing process to a printhead motion and jetting control to shift the at least one printhead.

15. The method according to claim 14, wherein N−1 shifting datum are allocated in a memory of the host processor, wherein the shifting datum are sequentially numbered from 1 to (N−1), wherein the (N−1) shifting datum are all set to 1 initially with the printhead being in the starting positions, and the shifting datum at the sequence numbers equal the difference between every two numbers of the defective jets are then adjusted to be zero in accordance with the measurement information from the printhead identification unit, wherein S can be equal to the sequence number of the shifting datum still assigned a value of 1.

16. The method according to claim 12, wherein a first printhead, a second printhead, and a third printhead parallel to the first and second printheads are provided, wherein the first and second printheads comprise M1 and M2 defective jets amongst the N jets respectively, wherein M1 and M2 represent a total number of the defective jets and both are less than N; wherein the first and second printheads are shifted up with the starting positions in the first printing process by a shared shifting distance equal to SH or (N−S)H such that replacement jets take the place of the defective jets, wherein H represents a distance between neighboring rows of the color pixels, wherein S is any integral number other than the difference between every two numbers of the defective jets of each of the first and second printheads when M1 and M2 are more than or equal to two, wherein S is any integral number when M1 and M2 are equal to 1.

17. The method according to claim 16, wherein the third printhead comprises M3 defective jets in the N jets, wherein M3 represents a total number of the defective jets and is less than N, wherein the third printhead is shifted up with the first and second printheads with the starting positions in the first printing process by a shifting distance equal to SH or (N−S)H such that replacement jets take the place of the defective jets, wherein H represents a distance between neighboring rows of the color pixels, wherein S represents a number of rows of color pixels, wherein S is less than N, wherein S is any integral number other than the difference between every two numbers of the defective jets of each of the first, second and third printheads when M1, M2 and M3 are more than or equal to two, wherein S is any integral number when M1, M2 and M3 are equal to 1.

18. The method according to claim 17, wherein three lists each consisting of N−1 shifting datum are allocated in a memory of the host processor, wherein the shifting datum are sequentially numbered from 1 to (N−1), wherein the shifting datum in the lists are all set to 1 initially in the starting positions, and the shifting datum at the sequence numbers of the difference between every two numbers of the defective jets of each of the printheads are then adjusted to be zero in accordance with the measurement information from the printhead identification unit, wherein S can be equal to a shared sequence number of the three lists at which the shifting datum thereof are still assigned a value of 1.

19. The method according to claim 12, wherein the color printing is a color filter.

20. A device for additional printing of a color printing, the device comprising:

a printhead identification unit for identifying at least one printhead for printing color pixels of the color printing by a first printing process, wherein each printhead consists of N jets and M defective jets, wherein N represents a total number of the jets and M represents a total number of the defective jets and is less than N, wherein the printhead identification unit is configured for calculating the numbers of the defective jets and sending measurement information of the N jets and the defective jets out; and a host processor for receiving the measurement information of the N jets and the defective jets from the printhead identification unit and sending movement instructions to a printhead motion and jetting control to shift the at least one printhead up with a starting position in the first printing process by a shifting distance equal to SH or (N−S)H such that enabling replacement jets take the place of the defective jets and are used to print the color printing by a second printing process, wherein H represents a distance between neighboring rows of the color pixels, wherein S represents a number of rows of color pixels, wherein S is less than N, wherein S is any natural number other than the difference between every two numbers of the defective jets when M is more than or equal to two, wherein S is any natural number when M equals to 1.

* * * * *